United States Patent [19]

Eddelman et al.

[11] 4,267,729

[45] May 19, 1981

[54] VOLUMETRIC PIPETTOR

[76] Inventors: Roy T. Eddelman, 60916 Terminal Annex, Los Angeles, Calif. 90054; Gregory F. Moran, 225 E. El Sur, Monrovia, Calif. 91016

[21] Appl. No.: 38,460

[22] Filed: May 14, 1979

[51] Int. Cl.[3] ..... B01L 3/02

[52] U.S. Cl. ..... 73/425.4 P

[58] Field of Search ..... 73/425.6, 425.4 P; 422/100

[56] References Cited

U.S. PATENT DOCUMENTS

| | | | |
|---|---|---|---|
| 2,423,173 | 7/1947 | Brady et al. | 73/425.4 P |
| 3,846,077 | 11/1974 | Ohringer | 422/100 |
| 3,855,867 | 12/1974 | Roach | 73/425.6 |
| 3,864,979 | 2/1975 | Ayres | 73/425.4 P |
| 3,891,392 | 6/1975 | Betts et al. | 73/425.4 P |
| 3,921,460 | 11/1975 | Schmidlin | 73/425.6 |

*Primary Examiner*—S. Clement Swisher

[57] ABSTRACT

A tip for use on a volumetric pipettor which tip contains a microporous membrane. The attached tip is attached to bellows and is immersed in a liquid, and the bellows of the pipettor are expanded pulling liquid through the tip to fill that portion of the tip located below the microporous membrane.

5 Claims, 6 Drawing Figures

FIG. 3.
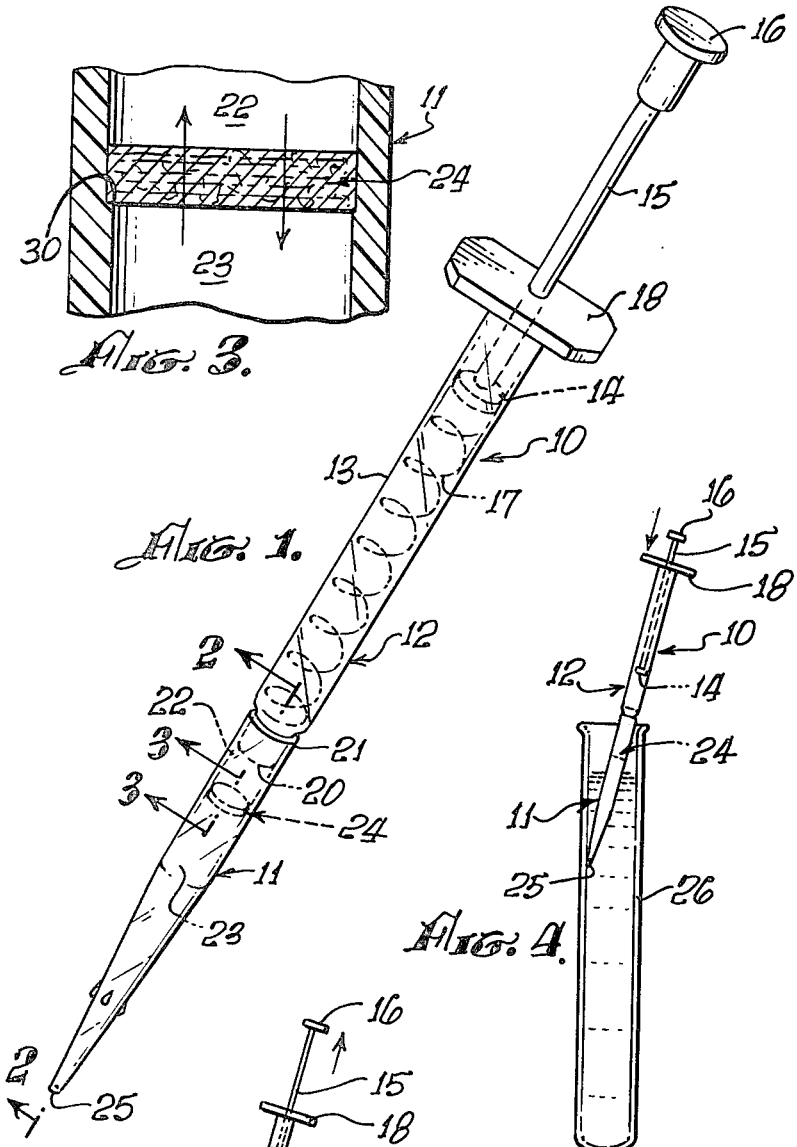
FIG. 1.
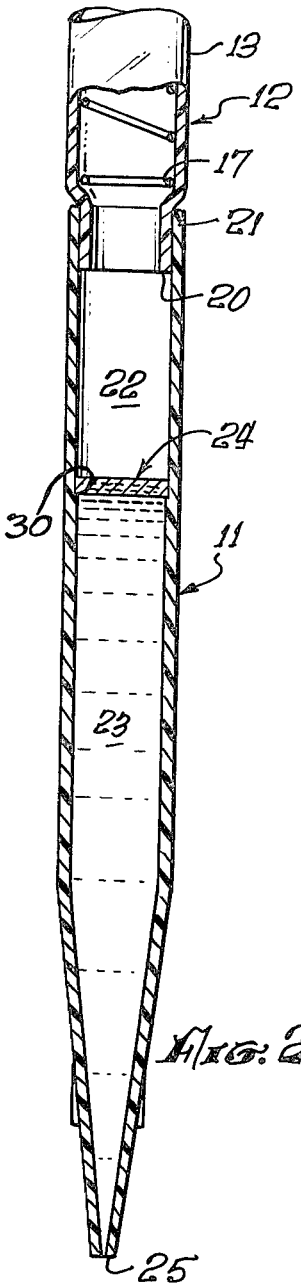
FIG. 2.
FIG. 4.
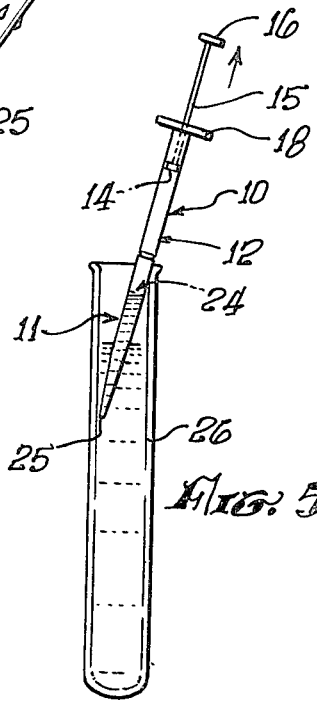
FIG. 5.
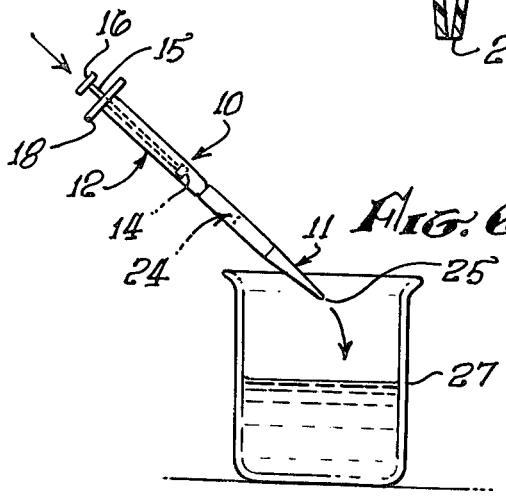
FIG. 6.

VOLUMETRIC PIPETTOR

BACKGROUND OF THE DISCLOSURE

The disclosure relates to pipettors of the type which are capable of picking up and ejecting an accurate volume of a liquid. Glass pipettes have been used for many years to draw up an accurate volume of liquid and eject it into a desired vessel. Typically, each pipette was graduated to draw up and measure a single volume of liquid. The volume of the liquid was determined typically by a graduated mark on the pipettor, and a certain amount of skill and care was required to obtain an accurate volume. Later, volumetric pipettors were developed which are capable of drawing in a particular volume of liquid by simply depressing and releasing a button located on the end of the pipettor. Further improvements were made by provision of means for adjusting a pipettor to eject varying volumes depending upon a setting on the adjustable pipettor.

Although volumetric pipettors and variable pipettors greatly facilitate the measurement of small volumes of liquid, they are both expensive and are capable of being incorrectly set or used. An inexpensive and essentially fool-proof device is needed to enable the rapid, accurate measurement volumes of liquid.

SUMMARY OF THE INVENTION

The present invention is for a volumetric pipettor tip for attachment to the bellows means of the pipettor for urging air or other gas inwardly and outwardly therefrom. The tip is affixed to the end of the bellows in an airtight relationship therewith. The tip has an upper chamber adjacent to the bellows and a lower chamber terminating in a lower opening. The lower chamber has a predetermined volume defined and limited by a partition separating the upper chamber from the lower chamber. The partition is sealingly positioned between the chambers of the tip and is fabricated from a microporous layer readily permeable to gasses and essentially impermeable to liquids. After the tip has been affixed to the bellows means, the lower opening of the tip is immersed in a liquid and the bellows is expanded. Liquid will move inwardly through the lower opening into the lower chamber until it fills the lower chamber and rests against the permeable microporous layer. The tip is then withdrawn from the liquid and the accurately measured volume of liquid may be ejected by depressing the bellows thereby forcing air back through the microporous membrane and pushing the liquid out of the lower portion of the chamber.

BRIEF DESCRIPTION OF THE DRAWINGS

FIG. 1 is a perspective view of the tip of the present invention attached to a pipettor.

FIG. 2 is an enlarged cross-sectional view taken along line 2—2 of FIG. 1.

FIG. 3 is an enlarged cross-sectional view taken along 3—3 of FIG. 1.

FIG. 4 is a side elevational view of the pipettor tip of the present invention attached to a pipettor and inserted into a test tube.

FIG. 5 is a side elevational view of the tip of the present invention inserted into a test tube.

FIG. 6 is a side elevational view of the tip of the present invention positioned over a beaker.

DESCRIPTION OF THE PREFERRED EMBODIMENTS

A volumetric pipettor 10 is shown in perspective view in FIG. 1. The pipettor has a tip portion indicated generally by reference character 11 and a bellows portion generally indicated by reference character 12. The bellows portion has a cylindrical chamber 13 which contains a piston 14 attached to a rod 15. Rod 15 is moved by contact with knob 16. Piston 14 is urged upwardly by spring 17.

The above-described spring-loaded piston and chamber arrangement, which is generally referred to herein as the bellows means, is of a conventional design. The present invention is for a tip which may be attached to existing bellows means, and the type of bellows shown in the drawing is merely one example of a commonly used type of bellows. The cylindrical chamber 13 is typically molded or extruded from a thermoplastic having a piston which should be made from a material exhibiting a low degree of friction. A finger grip 18 is held to the upper end of chamber 13 to facilitate movement of knob 16. Other bellows means may be used in place of the one shown in FIG. 1 since its function is merely to move air or other gas inwardly and outwardly from its lower end. The bellows could be a simple elastic bulb, an elastic accordian-shaped bellows or other air moving device.

The important feature of the present invention is embodied in the tip portion 11 which is shown most clearly in FIG. 2. The tip is placed over the lower end 20 of the bellows 12 in such a way that air does not escape between the upper end 21 of the tip 11 and the lower end 20 of the bellows 13. Tip 11 has an upper chamber 22 which is separated from the lower chamber 23 by a microporous member 24 which is welded or otherwise affixed across the inner surface of tip 11.

Microporous member 24 is shown most clearly in FIG. 3 and may be fabricated from numerous materials. One exemplary material is a microporous polypropylene film sold under the trademark Celgard 2400 by Celanese Plastic Company. This membrane has slit-like pores. The submicroscopic size of the pores allow the flow of gasses at a relatively high rate. For instance, with a differential pressure of ten pounds per square inch approximately 14 cubic inches of air pass through each square inch of the membrane per minute. Liquid flow is far less, however, and approximately 0.02 cubic inches of ethanol per minute flow through the same square inch of membrane with a ten pounds per square inch of differential pressure across the membrane. Thus about 700 times as much air passes through the membrane as ethanol with the same differential pressure. In a practical sense, air will pass through the membrane, and a liquid such as ethanol will not to any practical degree.

Therefore as shown in FIG. 2, if a partial vacuum is created in upper chamber 22 by the bellows 12 and the lower opening or spout 25 is inserted beneath the liquid surface as shown in FIG. 4, then the air will pass upwardly through microporous member 24, and the liquid will rise in the lower chamber 23 until it contacts member 24 as shown in FIG. 2. Because of the greatly decreased ability of liquid to pass through the microporous membrane, no significant amount of liquid will pass through the membrane and the lower portion of the chamber will remain full as shown both in FIG. 2 and FIG. 5. The pipettor tip is then withdrawn from the test tube 26, and the liquid is ejected into beaker 27 as shown in FIG. 6.

The positioning of microporous member 24 in tip 11, of course, determines the volume of liquid which may be withdrawn into lower chamber 23. One method for holding the membrane in the desired predetermined position is to glue or weld the membrane 24 to the inner surface of tip 11. Preferably a shoulder 30 is molded along the inner surface. A disc cut from the microporous membrane is placed through the upper end 21 of tip 11 and down against shoulder 30 and glued or welded thereto. A ring may then be glued or welded above the membrane securely holding it in place. A ring may not be necessary and should be used only if the additional support is needed. Alternatively, a bead of glue could be placed along the upper surface of shoulder 30, and the microporous disc inserted through the upper end 21 of tip 11 and lowered by a piston or other means to the predetermined desired location. In place of a ring, a spring or other device could hold the microporous disc in place. Furthermore, a ring could be adhered below member 24 in place of shoulder 30. The tip may be fabricated from polypropylene or other thermoplastic or from glass. Because of ease of fabrication and sterilization, polypropylene is a preferred material of construction.

A substantial advantage of the use of the present pipettor over those typically in use is that it is not necessary to use an expensive bellows to move an exact volume of air, but instead almost any air moving device can be connected to the tip of the present invention and a highly accurate amount of liquid measured. The volume of air moved by the bellows should exceed the volume of the lower chamber so that the lower chamber will fill completely. Tips having different lower chamber volumes may be readily fabricated simply by the placement of the microporous disc within the tip. Also, different tip sizes may be made for specific desired volumes.

Microporous membranes of the type useful with the present invention are now widely used in batteries and for filtration uses. The important feature of the membrane is, of course, its ability to permit air or other gasses to pass relatively freely through it and prevent water or other liquids from passing through it. Such films are often available both in a water repellent or water wetable condition, and either may be used with the practice of the present invention. A tip was made using a microporous polypropylene film having a thickness of one mil, a 38% pore volume with oblong pores approximately 0.02 by 0.2 micrometers as stated above. Other microporous membranes may be used as long as they have the relatively high degree of flow difference between gasses and liquids. The ratio of flow should be at least one order of magnitude and preferrably two orders of magnitude so that the membrane will not permit any substantial amount of liquid to pass therethrough.

Another advantage of the tip of the present invention is that it may readily be snapped on commercially available pipettors and does not require any special pipettor in order to be used. Alternatively, very inexpensive bellows may be used in place of commercially available pipettors.

The present embodiments of this invention are thus to be considered in all respects as illustrative and not restrictive; the scope of the invention being indicated by the appended claims rather than by the foregoing description. All changes which come within the meaning and range of equivalency of the claims therefore are intended to be embraced therein.

What is claimed is:

1. A tip for use on a volumetric pipettor having a bellows means, said tip comprising:

an upper chamber for attachment to the bellows means of the pipettor to which the chamber is to be attached in an airtight relationship therewith, said upper chamber being adjacent to a lower chamber terminating in a lower opening, said lower chamber having a predetermined volume defined and limited by a partition separating the upper chamber and lower chamber, said partition being sealingly positioned between the chambers and being permanently affixed to the intersection between the upper chamber and the lower chamber by a shoulder located within said tip, said partition being fabricated from a disc-shaped microporous layer readily permeable to gasses and essentially impermeable to liquids, whereby when said lower opening is immersed in a liquid and air is drawn inwardly from said upper chamber, the liquid will enter the lower chamber of the tip until the predetermined volume of liquid reaches the partition after which the lower opening may be removed from the liquid and the liquid ejected by moving air outwardly from the upper chamber and through the partition while retaining the partition in its position between the upper and lower chambers.

2. The tip of claim 1 wherein the microporous layer is a polypropylene membrane containing microporous openings.

3. The tip of claim 1 wherein said upper and lower chambers are fabricated from polypropylene.

4. The tip of claim 1 wherein said upper and lower chambers are integrally molded from a thermoplastic polymer.

5. The tip of claim 4 wherein a ring is positioned above said disc-shaped layer.

* * * * *